US012569079B2

(12) United States Patent
Simoni et al.

(10) Patent No.: US 12,569,079 B2
(45) Date of Patent: Mar. 10, 2026

(54) SUSPENDED WATCH HOLDER DISPLAY CONTAINER

(71) Applicant: FRACTION WATCH BOX, LLC, North Olmsted, OH (US)

(72) Inventors: Matthew Simoni, North Olmsted, OH (US); Clement Coletto, Ivano-Frankivsk (UA)

(73) Assignee: FRACTION WATCH BOX, LLC

( * ) Notice: Subject to any disclaimer, the term of this patent is extended or adjusted under 35 U.S.C. 154(b) by 20 days.

(21) Appl. No.: 18/762,856

(22) Filed: Jul. 3, 2024

(65) Prior Publication Data

US 2026/0007256 A1 Jan. 8, 2026

(51) Int. Cl.

| | |
|---|---|
| ***A45C 11/10*** | (2006.01) |
| ***A47F 7/03*** | (2006.01) |
| ***B65D 85/40*** | (2006.01) |
| *A47F 7/02* | (2006.01) |

(52) U.S. Cl.

CPC ..... *A47F 7/03* (2013.01); *A47F 7/022* (2013.01); *B65D 85/40* (2013.01)

(58) Field of Classification Search

CPC . A45C 11/10; A47F 7/03; A47F 7/022; G04D 7/009; B65D 85/40; G04B 37/14; G04B 37/0008

USPC ..... 206/566, 6.1, 301, 493, 18; 248/116; 368/316

See application file for complete search history.

(56) References Cited

U.S. PATENT DOCUMENTS 1,081,544 A * 12/1913 Masson ..... G04B 37/1473 248/442
1,423,329 A * 7/1922 Karr ..... A45C 11/10 206/18
1,615,324 A * 1/1927 Bulova ..... A47F 7/03 206/762
2,118,507 A * 5/1938 Guttman ..... A47F 7/03 248/116
2,650,785 A * 9/1953 Haister ..... A47F 7/022 248/116
2,695,151 A * 11/1954 Wilfrid ..... A47G 29/08 211/85.2
2,698,084 A * 12/1954 Burroughs ..... A45C 11/10 206/755
2,755,921 A * 7/1956 Ortendahl ..... A47F 7/03 206/755
3,809,216 A * 5/1974 Ferguson ..... A47F 3/005 206/45.24
D240,203 S * 6/1976 Howard ..... D9/422
3,999,818 A * 12/1976 Schankler ..... G11B 23/0236 312/107

(Continued)

*Primary Examiner* — Gideon R Weinerth

(74) *Attorney, Agent, or Firm* — Renner, Otto, Boisselle & Sklar, LLP

(57) ABSTRACT

A watch display container holds a watch via a suspended hanger. The suspended hanger keeps the watch safe and allows the display container to serve as safe packaging for transporting the watch between locations. Because the display case uses suspension to protect the watch, bulky padding is not needed, making the display container visually appealing to consumers. Multiple units of the disclosed display container may be attached to each other to form an extended display case that may stand freely on its own or be mounted to a supporting structure for easy watch exhibition.

19 Claims, 20 Drawing Sheets

(56) References Cited

U.S. PATENT DOCUMENTS 4,082,183 A * 4/1978 Sturm ..... A45C 11/10 206/301
4,216,858 A * 8/1980 Beauchamp ..... A47F 7/03 220/8
4,423,913 A * 1/1984 Lee ..... A47B 87/0276 312/118
4,707,146 A * 11/1987 Wein ..... A47F 7/022 248/116
4,830,181 A * 5/1989 Hartman ..... A47F 7/03 206/459.5
4,903,451 A * 2/1990 Gresswell ..... A47B 87/0276 52/584.1
4,936,466 A * 6/1990 Nava ..... A47F 7/02 248/176.1
4,986,426 A * 1/1991 Niklaus ..... A47F 5/11 248/116
5,136,557 A * 8/1992 Plawker ..... G09F 3/18 248/116
5,322,159 A * 6/1994 Houlihan ..... A45C 11/12 206/45.2
5,377,822 A * 1/1995 Herzog ..... A47F 7/022 206/301
5,383,552 A * 1/1995 Dikowitz ..... A45C 11/10 206/459.1
5,579,906 A * 12/1996 Fabbri ..... A45C 11/12 206/781
5,752,600 A * 5/1998 Kurashina ..... B65D 85/40 206/459.5
5,775,046 A * 7/1998 Fanger ..... A47B 87/007 108/158.12
5,799,911 A * 9/1998 Dostie ..... A47F 7/022 248/116
5,810,165 A * 9/1998 Lai ..... A45C 11/10 206/301
6,206,493 B1 * 3/2001 Sanchez-Levin ..... A47F 5/05 312/249.2
6,735,022 B1 * 5/2004 Solitt ..... A47F 11/06 359/802
D543,054 S * 5/2007 Au ..... G04D 7/009 D3/298
7,228,963 B1 * 6/2007 Feibelman ..... A47F 7/022 206/301
7,537,409 B2 * 5/2009 Huhnerbein ..... F16B 12/2009 403/348
9,114,325 B1 * 8/2015 Sternhill ..... A63H 33/067
D945,158 S * 3/2022 Holme ..... D3/297
11,804,115 B1 * 10/2023 Kelsch ..... G08B 13/1418
2003/0071176 A1 * 4/2003 Kirshner ..... A47F 7/022 248/116
2006/0028922 A1 * 2/2006 Wolf ..... G04D 7/009 368/316
2007/0119728 A1 * 5/2007 Au ..... E05B 73/00 206/301
2007/0223319 A1 * 9/2007 Hill ..... G04D 7/009 368/206
2008/0088210 A1 * 4/2008 Lerman ..... A47F 3/001 312/139.1
2010/0165798 A1 * 7/2010 Huang ..... G04D 7/009 368/206
2011/0147236 A1 * 6/2011 Johnson ..... A45C 11/16 206/6.1
2012/0201106 A1 * 8/2012 Nguyen ..... A47F 5/025 368/316
2015/0143957 A1 * 5/2015 Liao ..... G04D 7/009 81/7.5
2018/0153317 A1 * 6/2018 Haroush ..... A47F 7/024
2019/0384227 A1 * 12/2019 Tseng ..... H04N 23/51
2021/0059436 A1 * 3/2021 Lamontagne ..... A47F 7/024
2021/0223739 A1 * 7/2021 Briscombe ..... G04B 3/006
2022/0022667 A1 * 1/2022 Dubugnon ..... A47F 7/022

* cited by examiner

FIG. 6
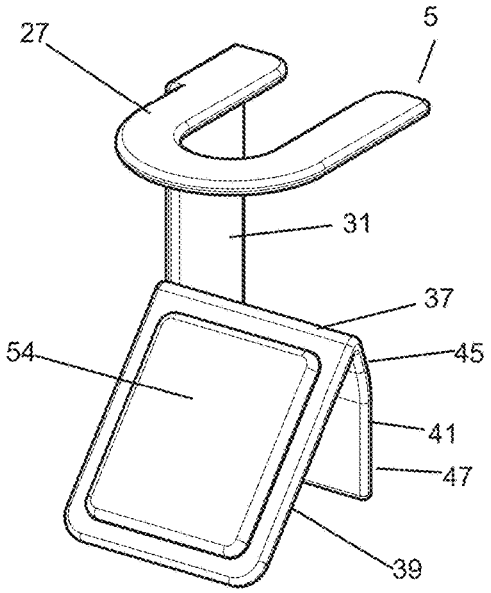
FIG. 7
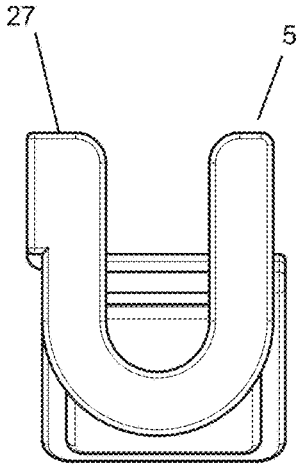
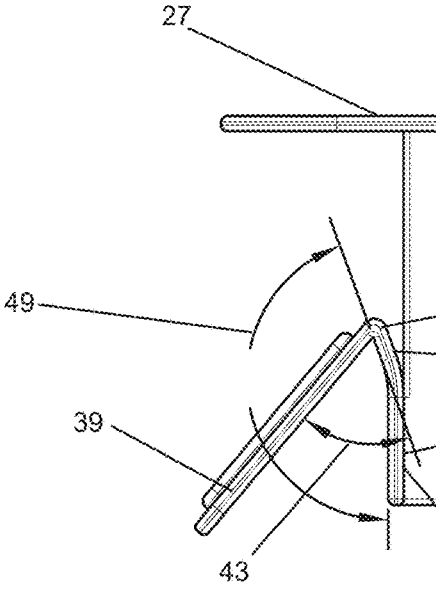
FIG. 8
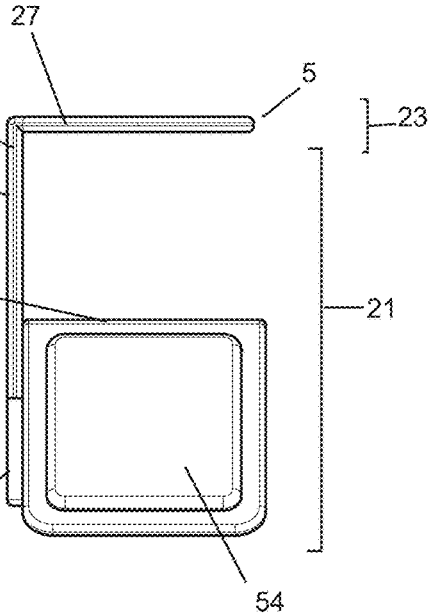
FIG. 9

SUSPENDED WATCH HOLDER DISPLAY CONTAINER

BACKGROUND OF THE ART

The present disclosure relates generally to watch holders and watch displays.

TECHNICAL FIELD

Collectors of luxury wristwatches often exhibit their collections for easy viewing. However, prior art wristwatch display containers are not well suited for transportation of said watches. As a result, anytime a watch needs to be transported to a new display location, the watch has to be removed from the display case, placed into a transportation case, moved to the new location, and then remounted into a display case. This multi-step transportation process offers many instances where a watch may be scratched, because each time the watch is moved the watch leaves the safety of a case and may be accidentally dropped and damaged.

Another downside of prior art watch cases is that manufacturers of luxury watches often have to ship luxury watches to purchasers in bulky padded containers. Because bulky padded containers are not visually appealing, the bulky packaging creates an undesirable image to the consumer receiving the watch. This undesirable image can hurt watch sales because purchasers of luxury watches also expect premium and visually appealing packaging for those watches.

SUMMARY

A wristwatch container suspends a watch to function as both a display and a transportation container.

According to an aspect of the disclosure, the apparatus is a luxury watch display case that holds watches via a suspended hanger. The suspended hanger keeps the watch safe and allows the display case to serve as safe packaging for transporting the luxury watch between locations. Because the display case uses suspension to protect and display the watch, bulky padding is not needed, making the display case visually appealing to consumers. Optionally, the apparatus may be used as a display container so the watch does not risk being scratched during insertion into a new display. Multiple units of the disclosed display case may be attached to each other to form an extended display that may stand freely on its own or be mounted to a supporting structure for easy watch exhibition.

According to an aspect of the disclosure, the apparatus is a superior display container that may be used to display wrist-watches from a unique elevated hanging position.

According to an embodiment of any paragraph(s) of this summary, the apparatus is a display container for luxury watches, wherein the container has a housing with walls that define an interior volume. The housing has at least one opening that allows a watch collector to put watches into the case's interior volume. A hanger mount is attached to at least one of the walls, and a hanger is suspended from the hanger mount such that the hanger only contacts the housing at the hanger mount. The hanger may be permanently attached to the hanger mount, or the hanger may be configured to removably attach to the hanger mount. In most cases when a watch is mounted on the hanger, no portion of the watch makes contact with the walls of the housing.

According to an embodiment of any paragraph(s), the disclosed container includes a housing with walls that encompasses an interior volume. The housing has at least one opening large enough to allow a wristwatch to be inserted into the display container. A hanger mount is attached to one of the walls, and a hanger is suspended from the hanger mount. Preferably, the hanger mount is attached to a topmost wall of the container and holds a watch in a position that prevents the watch from touching any of the walls of the container.

According to an embodiment of any paragraph(s), the disclosed container has a two-piece housing, wherein one of those pieces is a 5-sided parallelepiped and the second piece is an L-shaped portion.

According to an embodiment of any paragraph(s), the disclosed container walls may take the form of cubes, rectangular boxes, triangles, hexagons, and other polygon shapes.

According to an embodiment of any paragraph(s) the hanger may include a hanger connector and a hanger body. Both the connector and body may be continuously monolithic, or they may be separate components attached to each other. The hanger body may include a support with a proximal end attached to the hanger connector and a distal end extending away from the hanger connector. The distal end of the support is connected to an inverted V-shaped watch holder. The inverted V-shaped hanger has a first leg and a second leg. The first and second legs of the V-shaped hanger may be connected to each other at a first internal angle between 40 degrees and 70 degrees, and the first leg may be longer or equivalent in length to the length of the second leg. The second leg may have two planar portions connected to each other at a second internal angle between 150 degrees and 175 degrees.

According to an embodiment of any paragraph(s), the disclosed container may have a hanger with a first internal angle between 55 and 65 degrees, and a second internal angle between 160 and 170.

Most preferably, the first and second legs may be connected to each other at a first internal angle of 60 degrees, while the second leg's two planar portions are connected to each other at a second internal angle of 165 degrees. The second leg's two planar portions may be connected to each other via sharp angles, or via rounded curve edged angles.

According to an embodiment of any paragraph(s), the disclosed container may have a hanger with a first internal angle of 60 degrees, and a second internal angle between 165 degrees.

According to an embodiment of any paragraph(s), the disclosed container may have connectors on the exterior of the housing to attach display containers together to form a display case.

According to an embodiment of any paragraph(s), the disclosed container may be a slide-lock mechanism with connecting knobs that slide into grooves in the housing walls.

According to an embodiment of any paragraph(s), the disclosed container may include a lid which covers the opening in the housing.

According to an embodiment of any paragraph(s), the disclosed container may include spacers which fill a portion of the container's internal volume to immobilize the hanger. The spacers may be attached to a lid which covers the opening in the housing.

According to an embodiment of any paragraph(s), the disclosed container may include an internal light source which illuminates the interior volume of the container to make watches more visible. The light source may be powered, fluorescent, or powered and fluorescent. If the light source is powered, a power source or power circuit may travel through the connectors on the exterior of the housing. A processor may be attached to the light source to control the light source's functions.

According to an embodiment of any paragraph(s), the disclosed container may include a motor attached to a hanger connector or hanger mount to rotate the hanger within the container. The motor may be powered by a power circuit, and the power circuit may travel through the connectors on the exterior of the container's housing. A controller may be attached to the motor to control the rotation of the motor.

According to an embodiment of any paragraph(s), the disclosed container may include a mount attached to the container housing so that the container may the affixed to a free-standing structure.

According to an embodiment of any paragraph(s), the disclosed container may be used as a kit to ship or transport watches without bulky packaging. The kit would include the disclosed container and a watch.

While a number of features are described herein with respect to embodiments of the disclosure; features described with respect to a given embodiment also may be employed in connection with other embodiments. The following description and the annexed drawings set forth certain illustrative embodiments of the disclosure. These embodiments are indicative, however, of but a few of the various ways in which the principles of the disclosure may be employed. Other objects, advantages, and novel features according to aspects of the disclosure will become apparent from the following detailed description when considered in conjunction with the drawings.

BRIEF DESCRIPTION OF THE DRAWINGS

The annexed drawings, which are not necessarily to scale, show various aspects of the disclosure.

FIG. 6 is a front right-side elevated view of one embodiment of the disclosed container's hanger.

FIG. 7 is a top view of one embodiment of the disclosed container's hanger.

FIG. 8 is a right-side view of one embodiment of the disclosed container's hanger.

FIG. 9 is a front view of one embodiment of the disclosed container's hanger.

DETAILED DESCRIPTION

Figure 1:
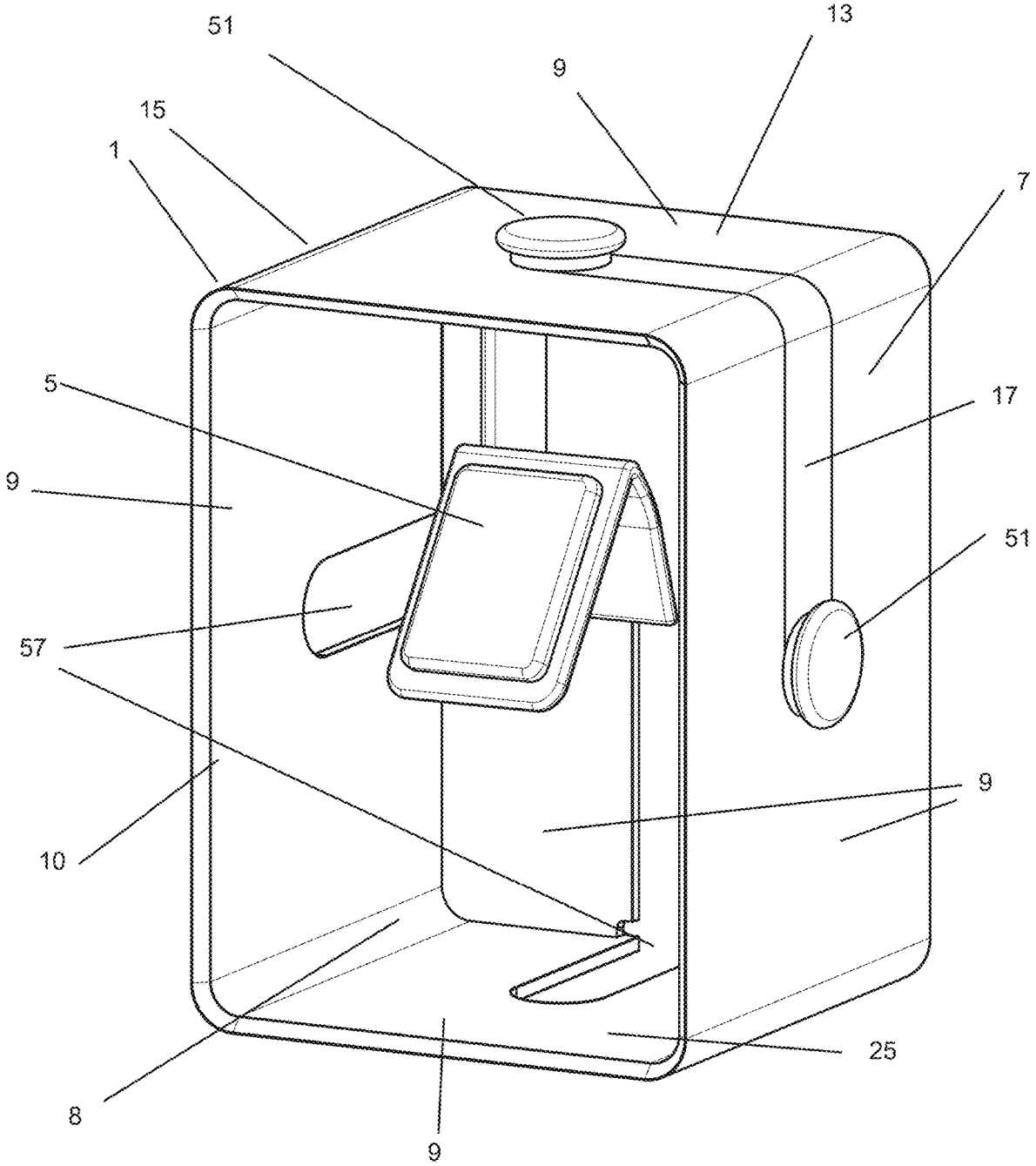
FIG. 1 is a front right perspective view of one embodiment of the disclosed container.
Figure 2:
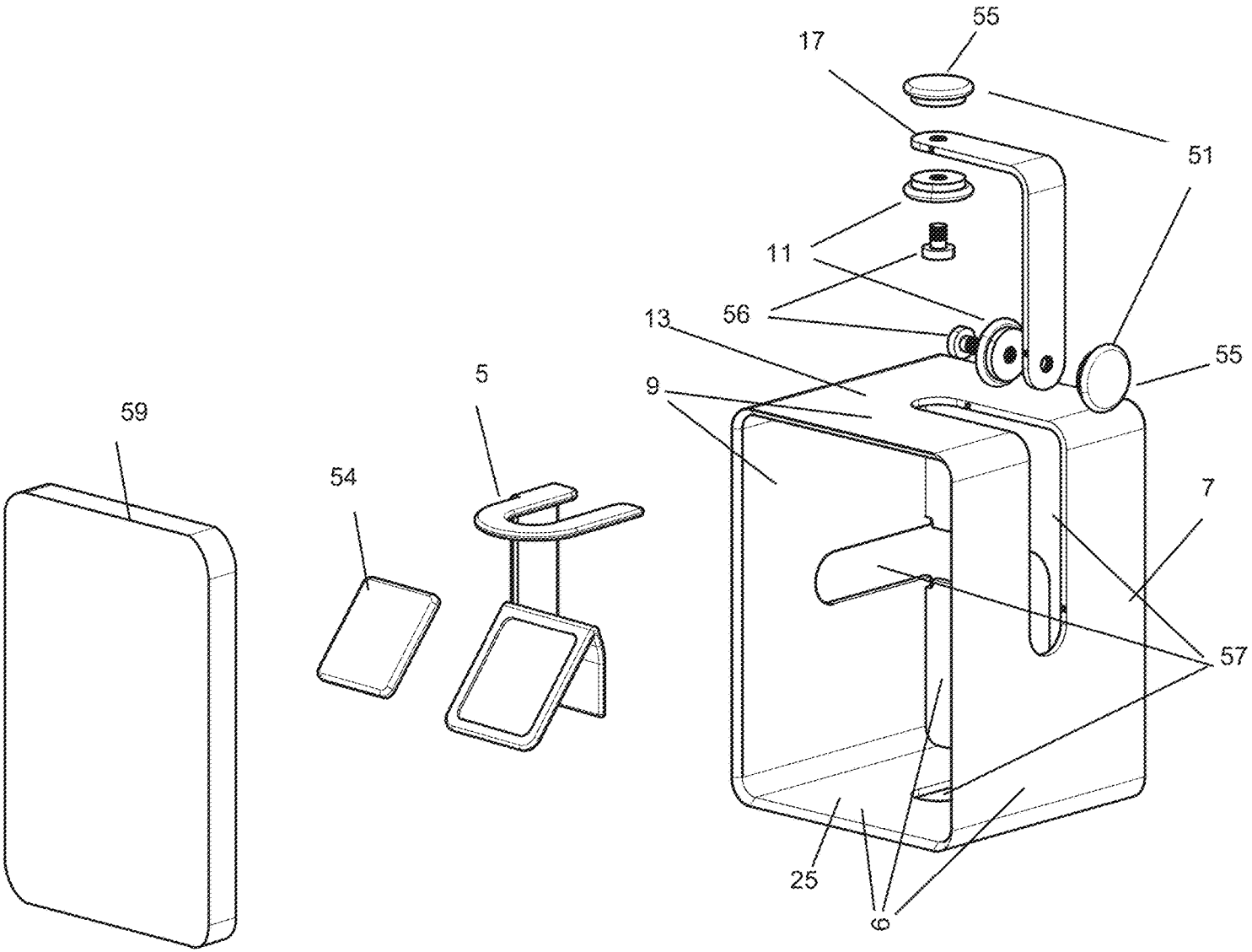
FIG. 2 is an exploded view of one embodiment of the disclosed container.
Figure 3:
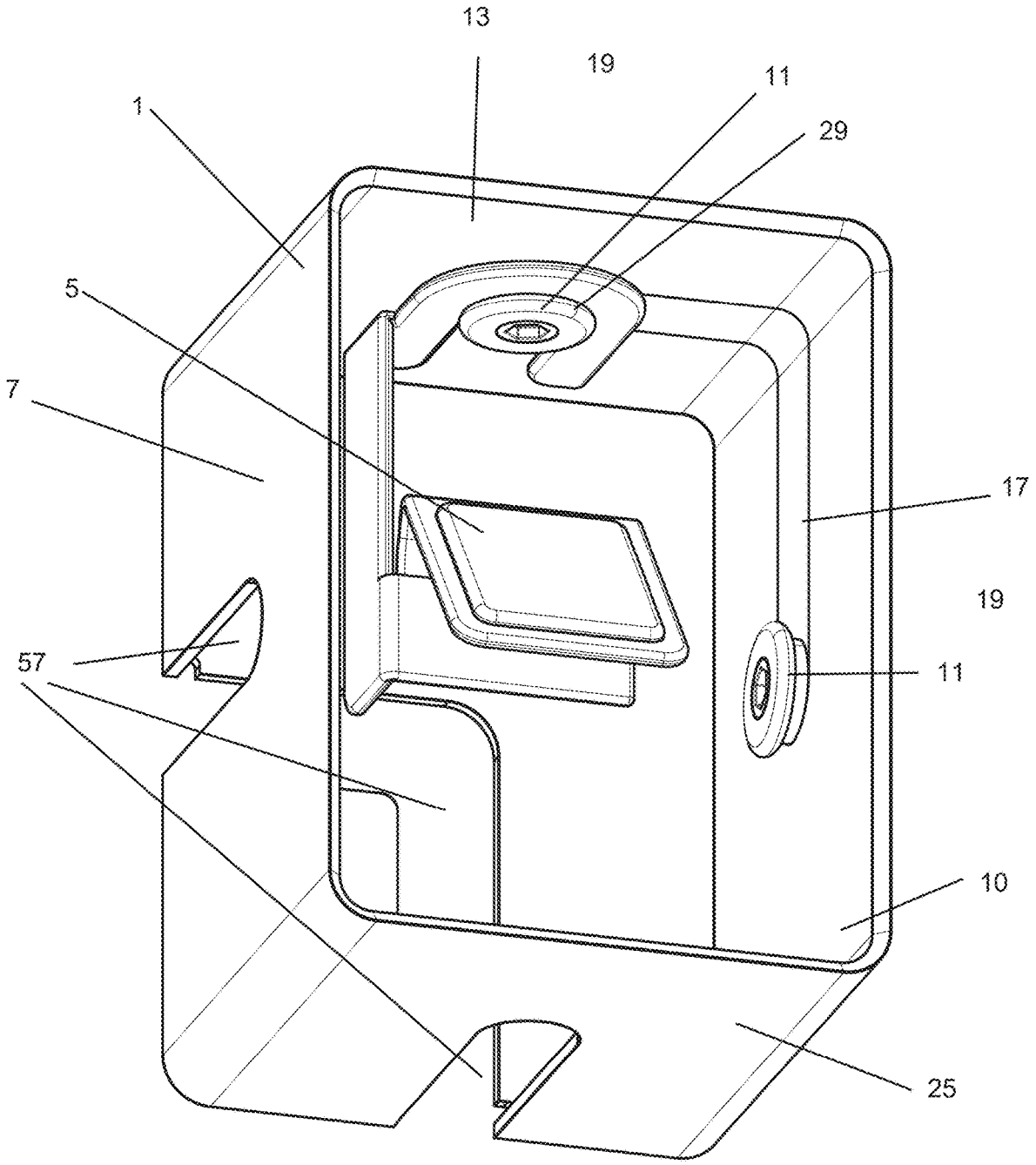
FIG. 3 is a bottom left-side view of one embodiment of the disclosed container

The disclosed apparatus is a luxury watch display container 1 that holds watches 3 via a suspended hanger 5. The suspended hanger 5 keeps the watch safe and allows the display container 1 to serve as safe packaging for transporting a luxury watch 3 between locations. Because the disclosed display container 1 uses suspension to protect the watch, bulky padding is not needed, making the display container visually appealing to consumers. Multiple units of the disclosed display container may be attached to each other to form an extended display case that may stand freely on its own or be mounted to a supporting structure for easy watch exhibition. The disclosed container may be used as a display container when the watch is not being transported.

Because watches are suspended away from the disclosed display container's floor by a watch hanger, watches in the disclosed display are more observable than in prior art display cases. Furthermore, the suspension effect of the container inherently holds the watch away from contact with the walls of the container's housing, protecting the watch from damage or scratches.

This hanging effect means the disclosed display container can serve a dual purpose as both a display container and as a transportation container which prevents scratches. This removes the need for repeatedly handling a watch when moving the watch between separate display and transportation cases. As a result of this reduced need for handling, the disclosed apparatus provides better protection for watches by minimizing scratch chances. Furthermore, the suspension of the watch means the disclosed container does not need bulky padding to safely ship or transport the watches. Accordingly, the disclosed container may be used to ship watches from the manufacturer in a more consumer appealing package.

With reference to the drawings, and in particular to FIGS. 1-5, a container includes a housing 7 with walls 9 that encompasses an interior volume 8. The housing 7 has at least one opening 10 large enough to allow a wristwatch 3 to be inserted into the display container 1. A hanger mount 11 is attached to one of the walls 9, and a hanger 5 is suspended from the hanger mount 11. Preferably, the hanger mount 11 is attached to a topmost wall 13 of the container 1 and holds a watch 3 in a position that prevents the watch 3 from touching any of the walls 9 of the container 1.

The housing 7 may be partially or wholly formed out of metal, wood, glass, crystal, carbon fiber, or polymer. The interior of the housing may be partially or wholly reflective to allow better distribution of light throughout the container, or to allow observers to view a watch from different simultaneous perspectives. The housing may optionally be transparent to increase the visibility of watches 3 suspended inside the container 1. Furthermore, the housing 7 may be formed out of a monolithic single continuous piece of material, or out of several components which attach together to enclose the housing's interior volume.

In one embodiment, the housing is composed of only two pieces, wherein one of those pieces is a 5-sided parallelepiped 15 and the second piece is an L-shaped portion 17 which removably attaches to the 5-sided parallelepiped 15 and wraps around two of the parallelepiped's sides. The hanger mount 11 is attached to the housing's top-most wall 13, and may optionally attach to the L-shaped portion 17 if the L-shaped portion 17 is a portion of the top-most wall 13 of the housing. The hanger 5 hangs from the top 13 of the display container to suspend the hanger 5 (and wristwatch 3) from making any contact with any wall 9 of the display container 1.

With reference to FIG. 1, the housing's walls 9 may take a geometric shape which encloses an interior volume 8. The housing 7 geometry is preferably selected to be a shape that allows multiple disclosed containers 1 to be stacked adjacent to each other with minimal gaps between containers. Accordingly, the housing's walls may take the form of cubes, rectangular boxes, triangles, hexagons, and other polygon shapes. The housing may have interior divider walls which divide the container into separate subcompartments. Each subcompartment may contain a hanger configured to suspend a watch.

A hanger mount 11 is attached to at least one of the housing walls 9 on the interior volume sides of said walls. The hanger mount 11 may be a connector 19 configured to permanently or removably attach to a hanger. Snap buttons, hook loop fasteners, adhesives, screws, bolts, nuts, rails, rail grooves, magnets, or any suitable fastener may be used for the rail mount. In one embodiment of the disclosed container, the hanger mount is a knob, screw, or bolt which may be tightened or loosened to move the knob, screw, or bolt respectively closer to or further from the housing wall. Multiple hanger mounts 11 may be used within each container 1 so that multiple hangers 5 may be hung simultaneously, or so that the hanger 5 may be hung from different walls 9 of the housing 7. The hanger 5 may include a pad or cushion 54 which insulates the hanger 5 from a watch 3.

With reference to FIGS. 6-11, the hanger 5 includes a hanger body 21 and a hanger connector 23 capable of attaching to the hanger mount 11. The hanger body 21 may take the form of any suitable structure that suspends a watch 3 away from the walls 9 of a display container 1 without the watch 3 or the hanger 5 contacting a bottom-most wall 25 or floor of the container. Optionally, the hanger body 21 may include a latch, catch, or clip to more securely hold the watch 3 in place upon the hanger 5. The hanger body 21 may be composed of several distinct components, or may be formed out of one continuous monolithic single piece of material.

Figure 4:
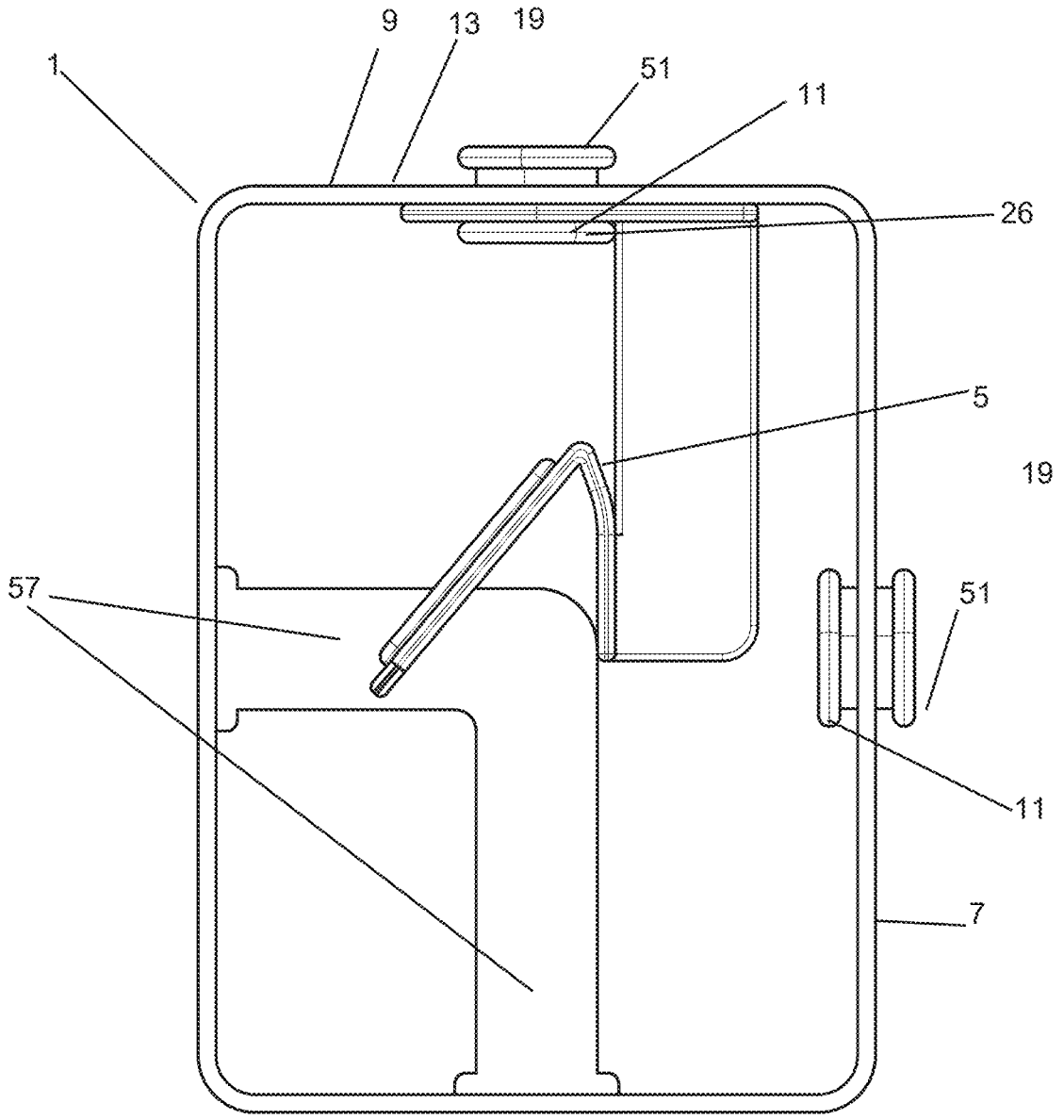
FIG. 4 is a front view of one embodiment of the disclosed container with the hanger rotated inside the container.
Figure 5:
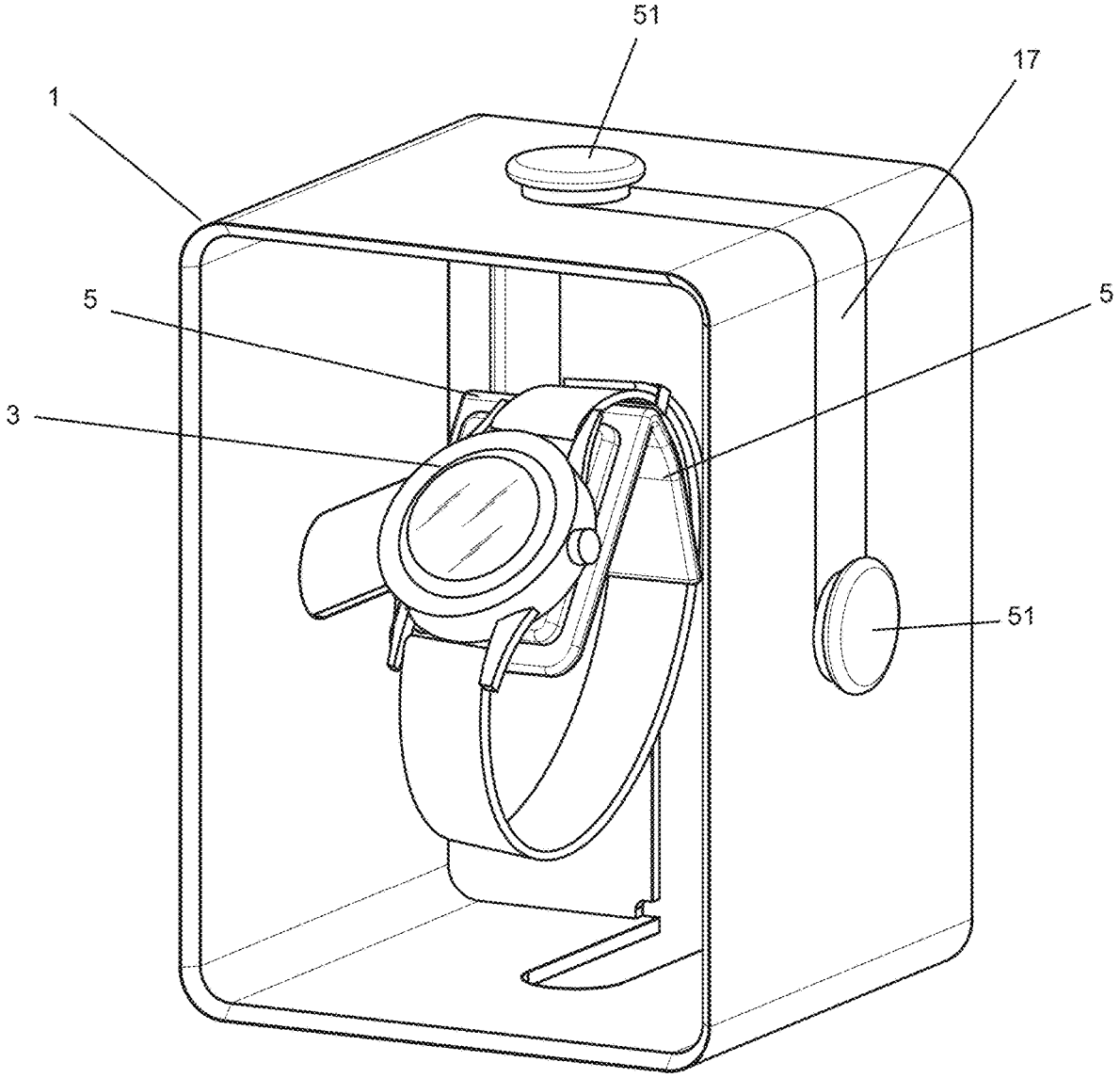
FIG. 5 is a front right-side elevational view of one embodiment of the container holding a wristwatch.
Figure 10:
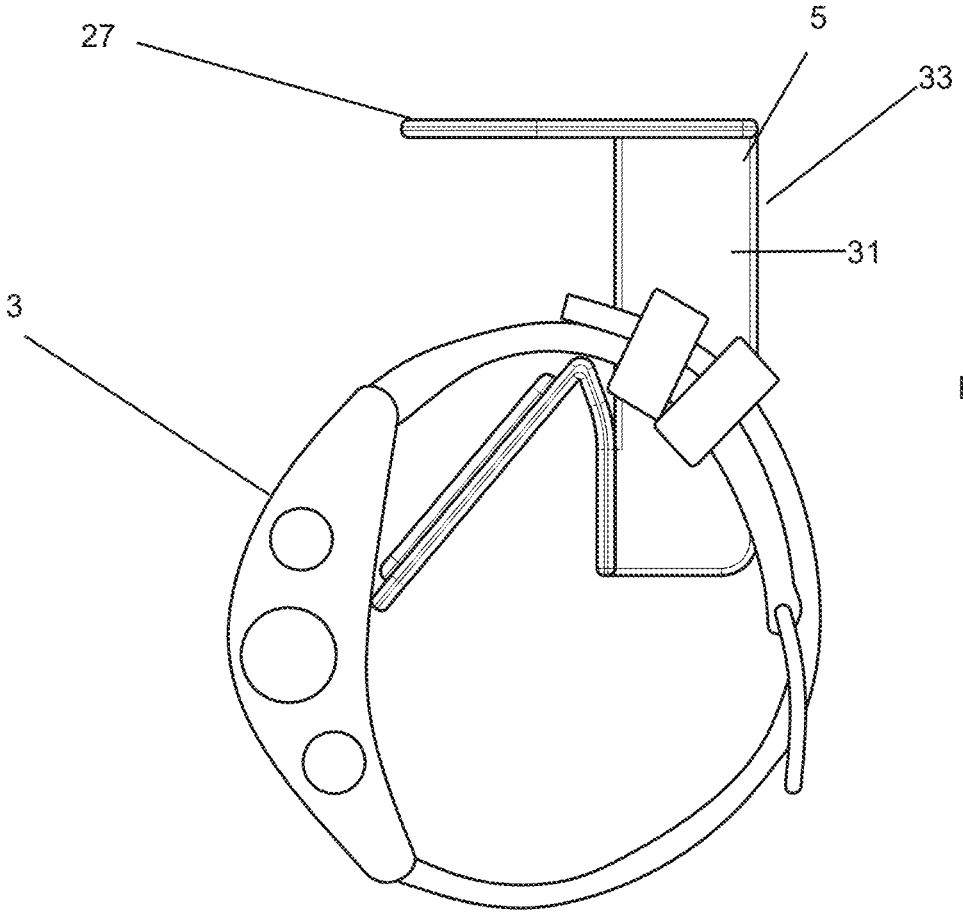
FIG. 10 is a right-side view of one embodiment of the disclosed container's hanger holding a wristwatch.
Figure 11:
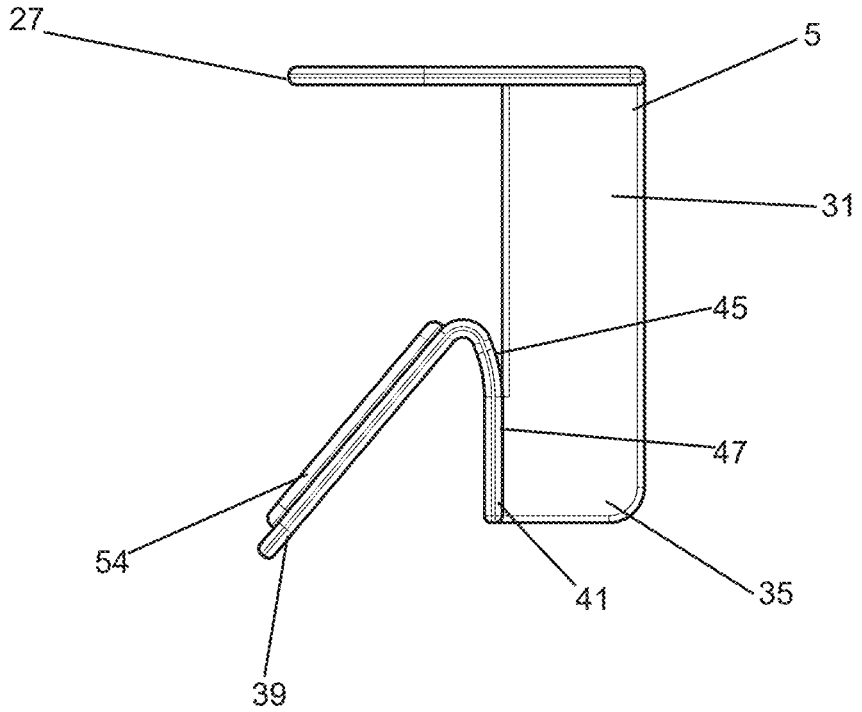
FIG. 11 is a right-side view of one embodiment of the disclosed container's hanger without the wristwatch.

The hanger connector 23 may be continuously monolithic with the hanger's body 21, or the hanger connector 23 may be a separate object that is attached to the hanger body. The hanger connector 23 may be configured to attach to the hanger mount 11 either permanently or removably. As shown in FIG. 4, the hanger connector 23 may optionally contain a rotational device 26 which allows the hanger 5 to rotate within the container's interior volume. Examples of this rotational device include, but are not limited to, joints, hinges, axles, knobs and bearings.

As shown in FIGS. 7 and 8, in one embodiment, the hanger connector 23 has a U-shape 27 which wraps around a hanger mount knob 29. When the hanger knob 29 is tightened, the hanger 5 is held in place. When the hanger mount knob 29 is loosened, the hanger 5 may be rotated within the interior volume or removed from the container 1.

As shown in FIGS. 8-9, In one embodiment of the apparatus, the hanger 5 includes a hanger connector 23 and hanger body 21 which are a single piece of material that is continuously monolithic. The hanger body 21 may include a support 31 with a proximal end 33 attached to the hanger connector 23, and a distal end 35 extending away from the hanger connector 23. The distal end 35 of the support 31 is connected to an inverted V-shaped watch holder 37.

The inverted V-shaped holder 37 has a first leg 39 and a second leg 41 which may be connected to each other via sharp angles, or via rounded curve edged angles. The first and second legs of the V-shaped holder 37 may be connected to each other at a first internal angle 43 between 40 degrees and 70 degrees, and the first leg 39 may be longer than or equal to in length of the second leg 41. The second leg may have a first planar portion 45 and a second planar portion 47 connected to each other at a second internal angle 49 between 150 degrees and 175 degrees. More preferably, the first and second legs 39, 41 may be connected to each other a first internal angle 43 between 55 and 65 degrees, while the second leg's two planar portions 45, 47 are connected to each other at a second internal angle 49 between 160 and 170. Most preferably, the first and second legs may be connected to each other at a first internal angle 43 of 60 degrees, while the second leg's two planar portions 45, 47 are connected to each other at a second internal angle 49 of 165 degrees. The second leg's two planar portions 45, 47 may be connected to each other via sharp angles, or via rounded curve edged angles.

Alternatively, the second leg 41 may only contain a single planar portion, wherein the single planar portion connects to the first leg 39 at an internal angle 43 preferably between 40 degrees and 70 degrees, more preferably between 55 and 65 degrees, and most preferably at an internal angle 43 of 60 degrees.

Figure 12:
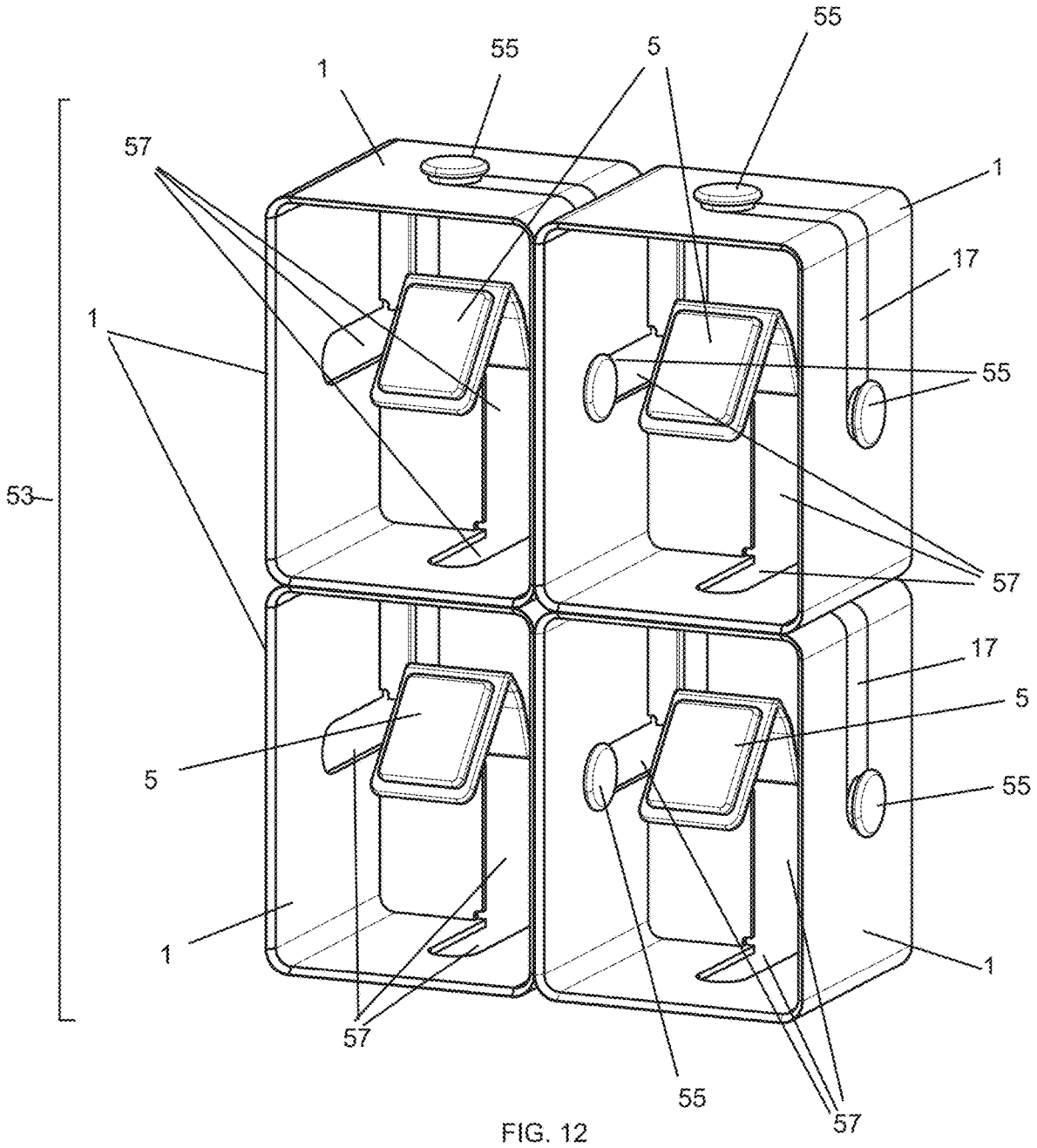
FIG. 12 is a front right-side elevational view of multiple disclosed containers attached together to form one embodiment of the disclosed display case.
Figure 13:
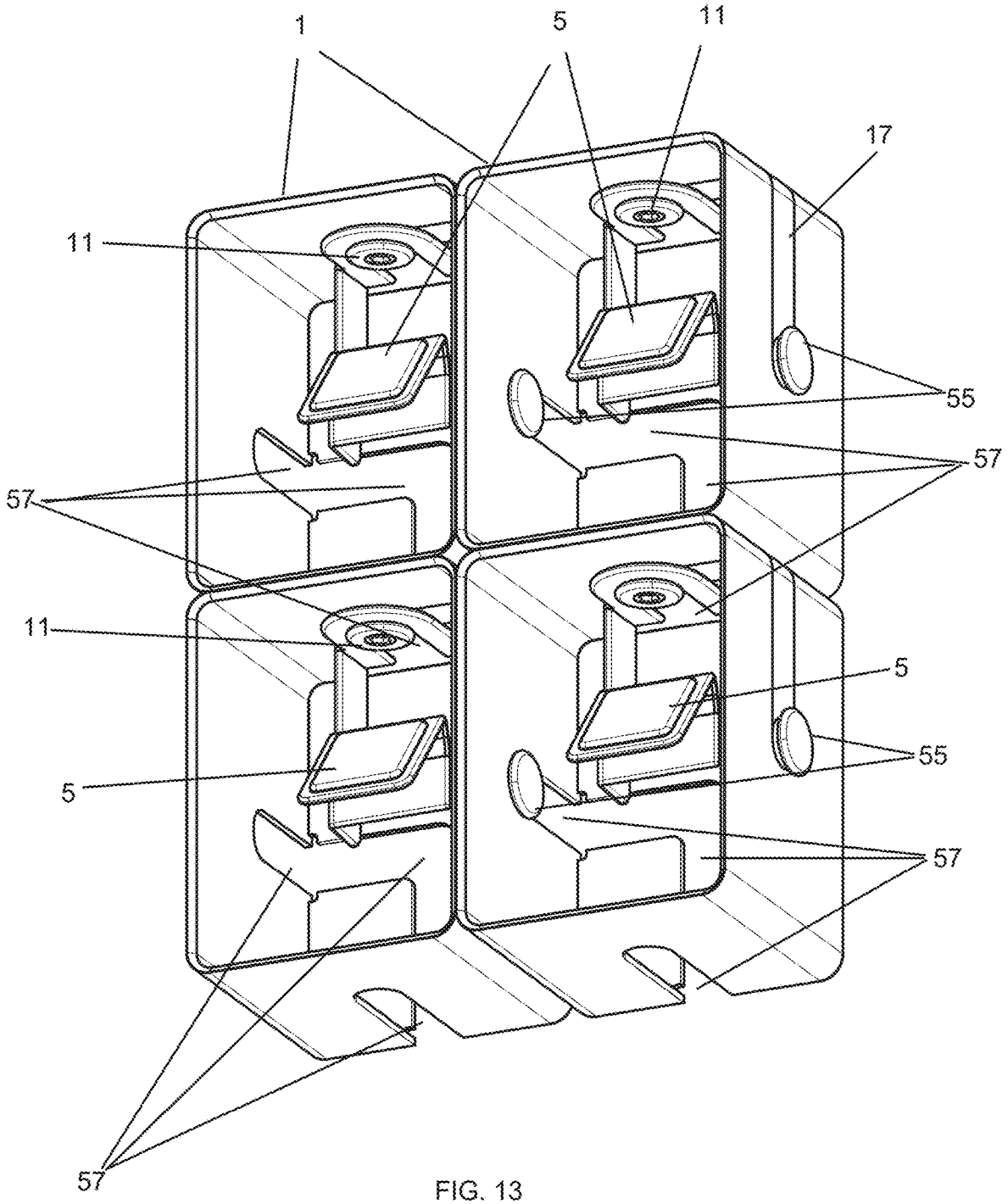
FIG. 13 is a bottom right-side elevational view of multiple disclosed containers attached together to form one embodiment of the disclosed display case.
Figure 14:
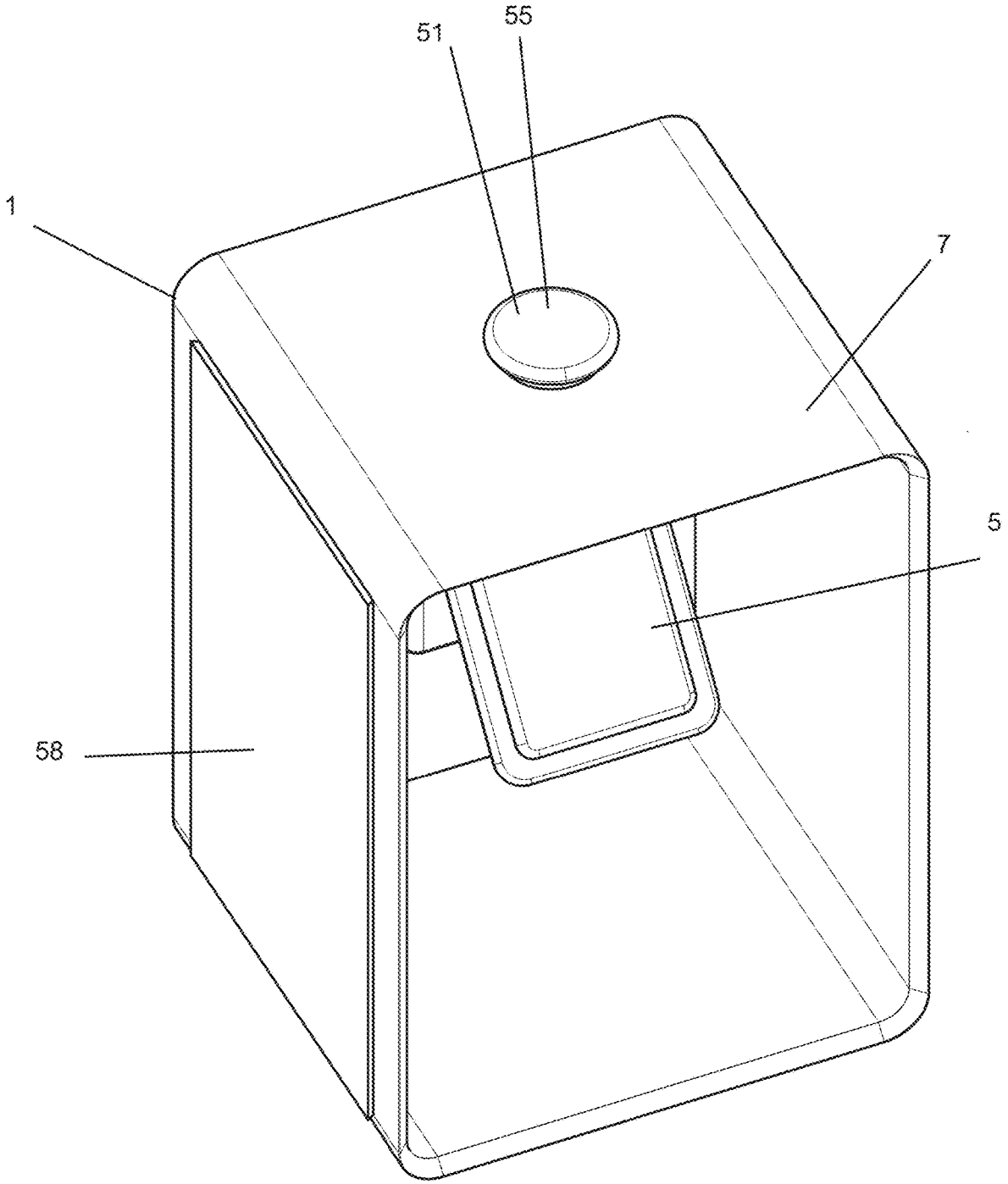
FIG. 14 is a top left side elevational view of one embodiment of the disclosed container with a rail connector system.
Figure 15:
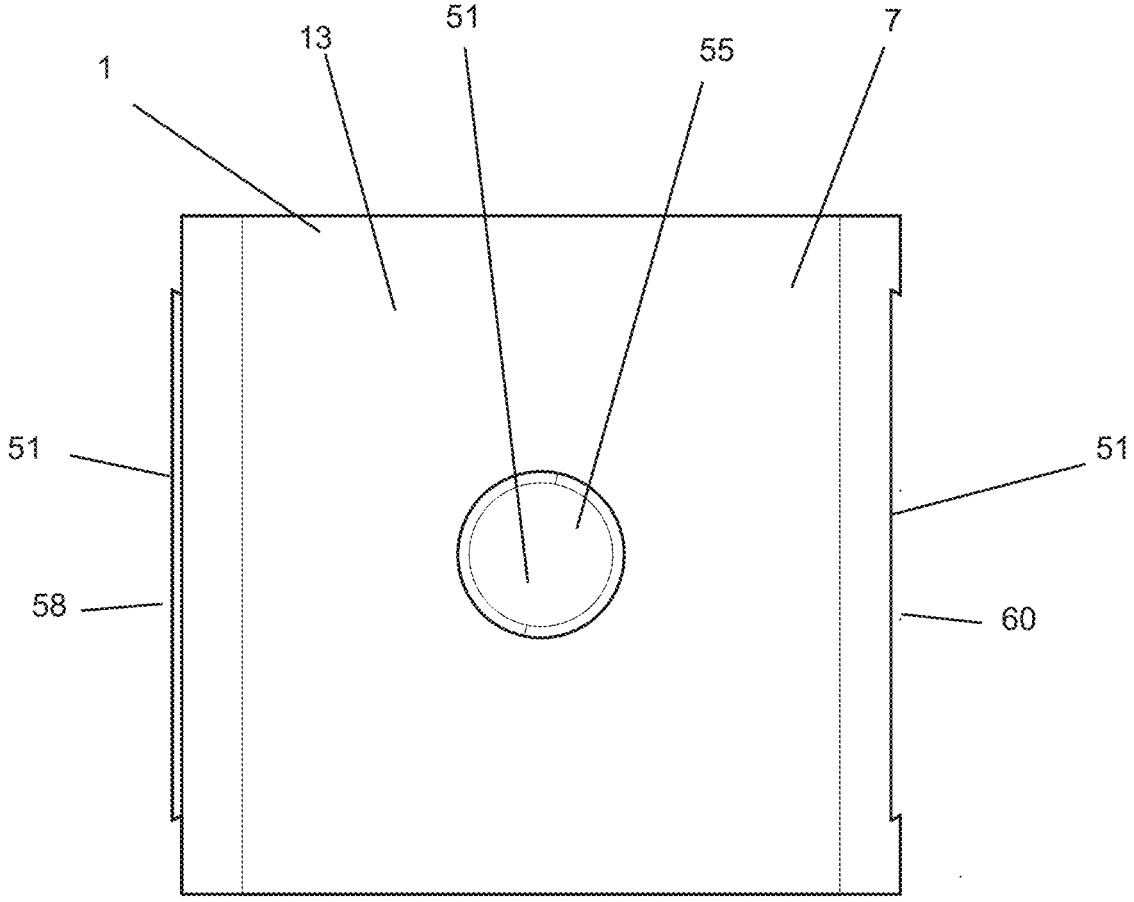
FIG. 15 is a top view of one embodiment of the disclosed container with a rail connector system.
Figure 16:
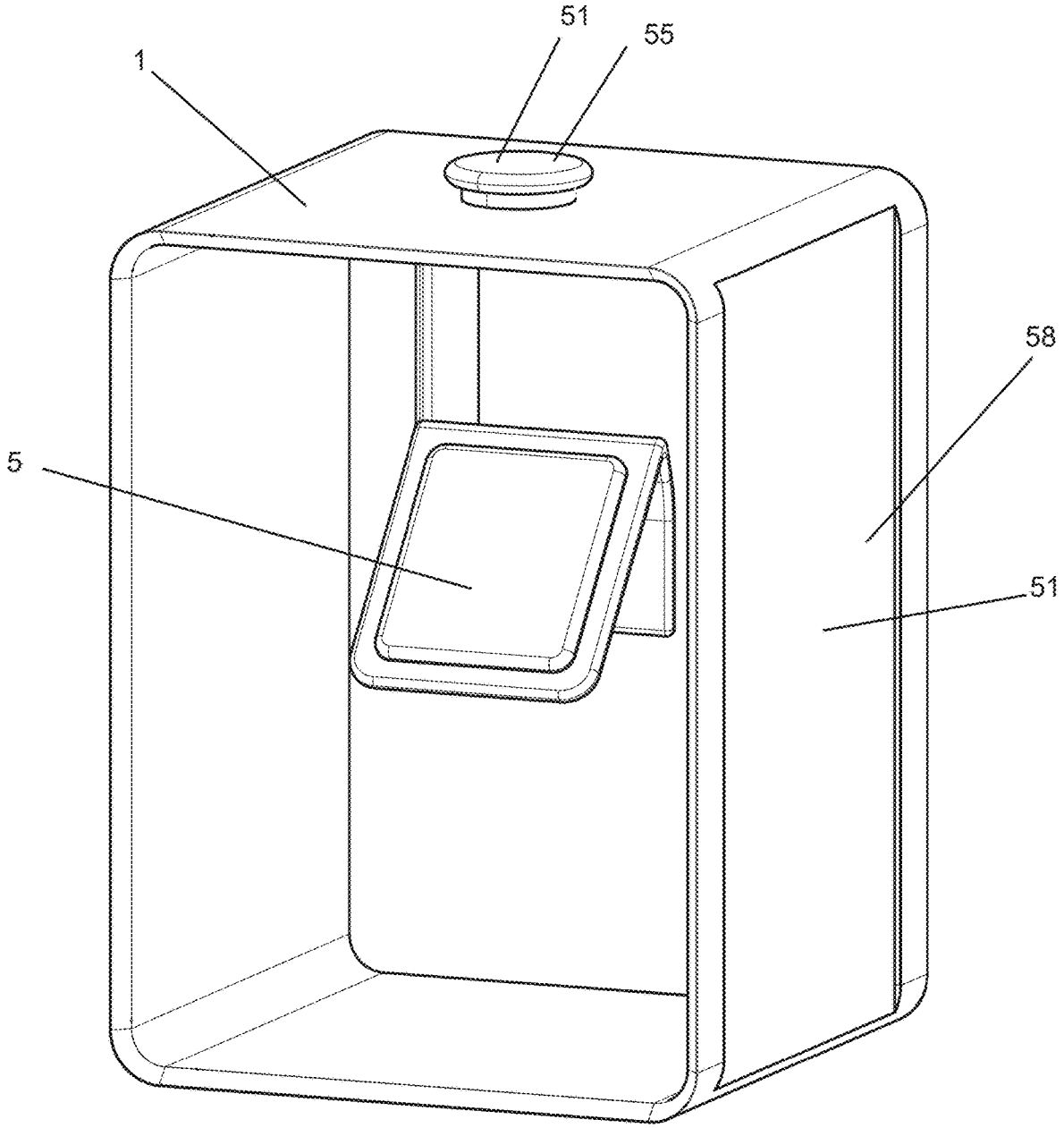
FIG. 16 is a front right view of one embodiment of the disclosed container with a rail connector system.
Figure 17:
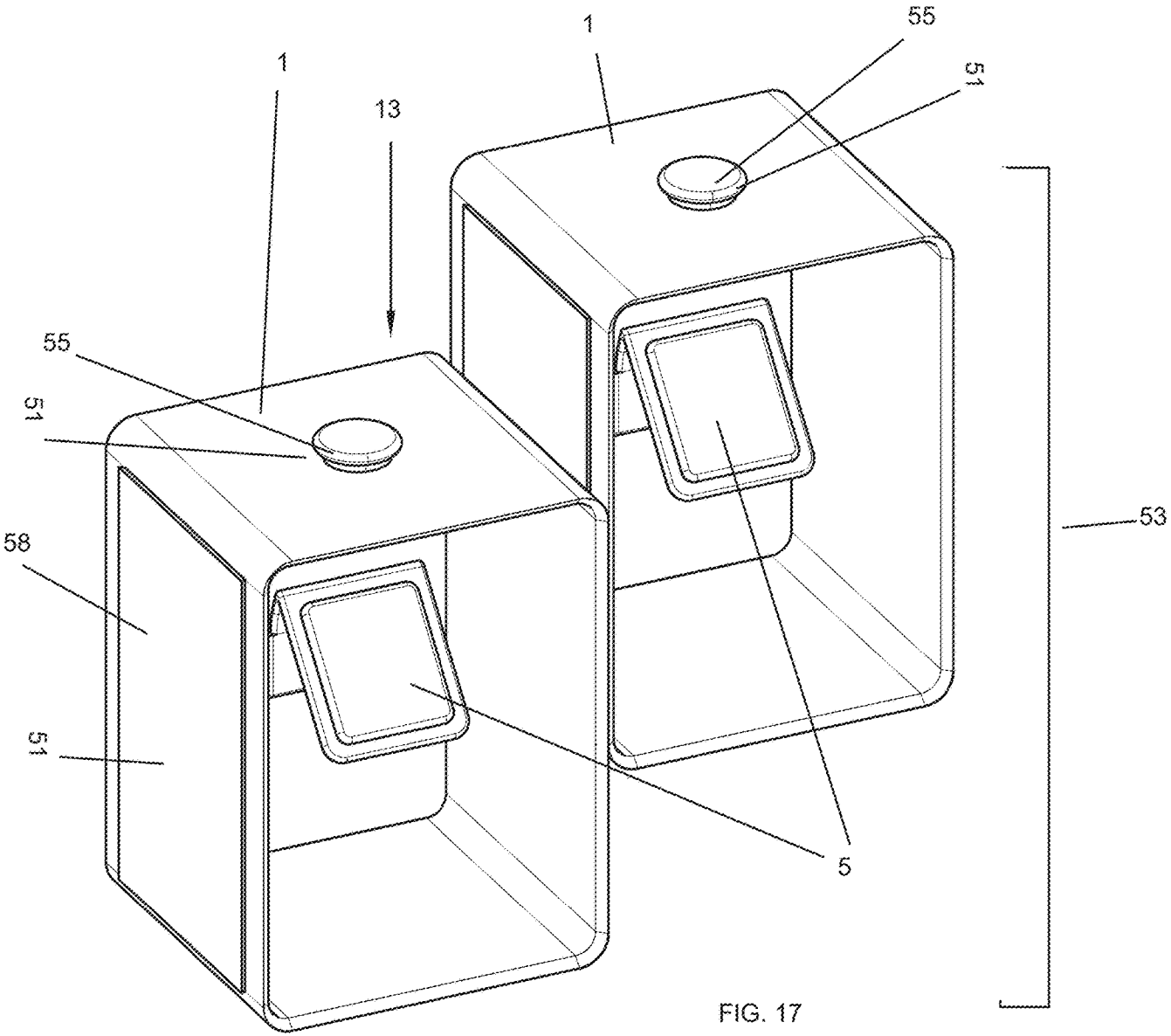
FIG. 17 is a top left side elevational view demonstrating how multiple of the disclosed containers attach together via the rail system to form one embodiment of the disclosed display case.

As shown in FIGS. 12, 13, and 17, connectors 51 may be attached to the exterior surface of the housing 7. The connectors 51 are used to attach multiple display containers 1 together and form a display case 53. Snap buttons, hook loop fasteners, adhesives, screws, bolts, nuts, rails, rail grooves, magnets, or any suitable fastener which can hold display containers together may be used. Preferably, the connectors 51 are chosen and located so that the display containers 1 sit flush to each other when the display containers are connected to each other. Connectors 51 may be permanently or removably attached to the housing 7 depending upon the durability and repair needs of the display container. If the connectors 51 are permanently attached, the connectors will generally be more durable. However, if the connectors are removeable, then they will generally be easier to replace if a connector breaks.

In one embodiment of the disclosed container shown in FIGS. 3-5 and 12 and 13, the connector 51 takes the form of a side-lock mechanism. In this slide-lock mechanism, connector knobs 55 are mounted on the housing, while grooves 57 are cut into or through the housing 7. When two containers are connected, the connector knobs 55 slide into a groove 57 and the connector knobs 55 are tightened to lock the containers together in place. The connector knobs 55 may be optionally loosened to allow the containers to rotate relative to each other. Optionally, the connector knobs may have a central screw or bolt 56 that allows the knob to be tightened or loosened. The connector knobs 55 may optionally serve as the hanger mount.

In another embodiment of the claimed invention shown in FIGS. 14-17, the container 1 may have multiple types of connectors 51. For example, the container may have rails 58 and rail groove connectors 60 on several sides of the container 1, and a connecting knob 55 on other sides of the container. As shown in FIG. 17, the rail 58 and rail groove connectors 60 may function when the user of the container slides a rail 58 of one container into the rail groove 60 of another container to form a display case 53.

Figure 18:
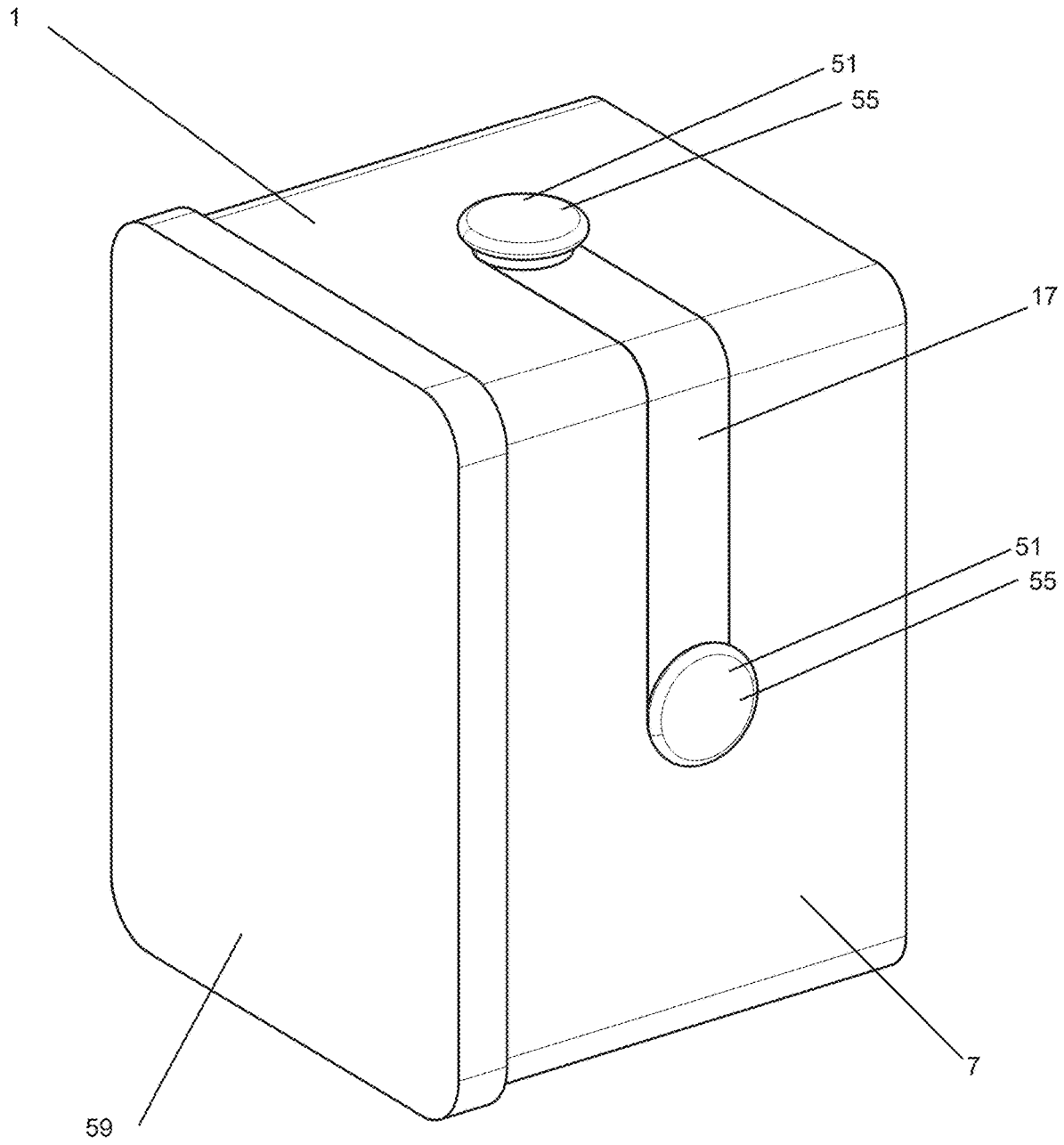
FIG. 18 is a front right side elevational view of one embodiment of the disclosed container with the container's opening covered by a lid.
Figure 19:
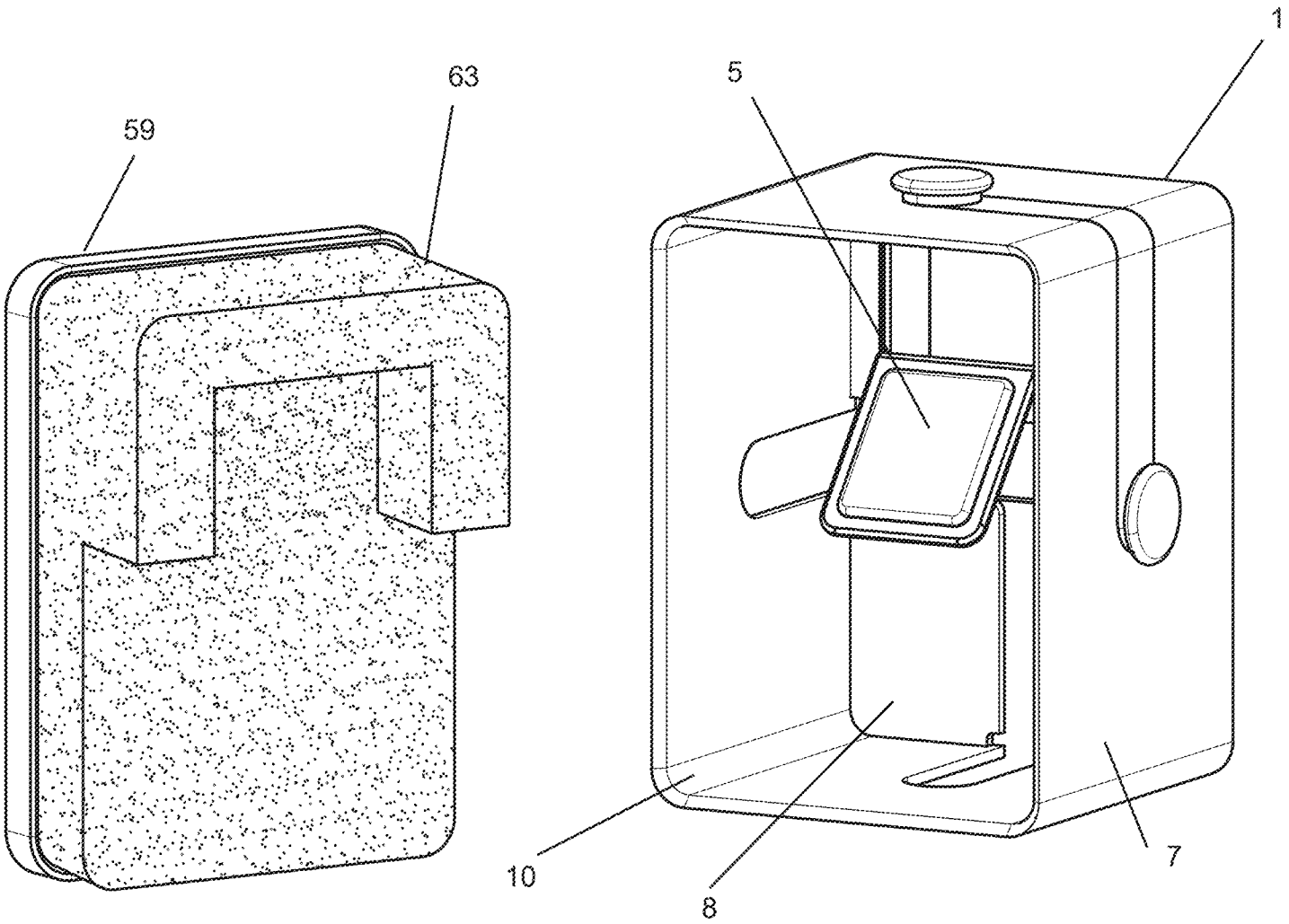
FIG. 19 is an exploded view of one embodiment of the disclosed container, and a lid with a spacer
Figure 20:
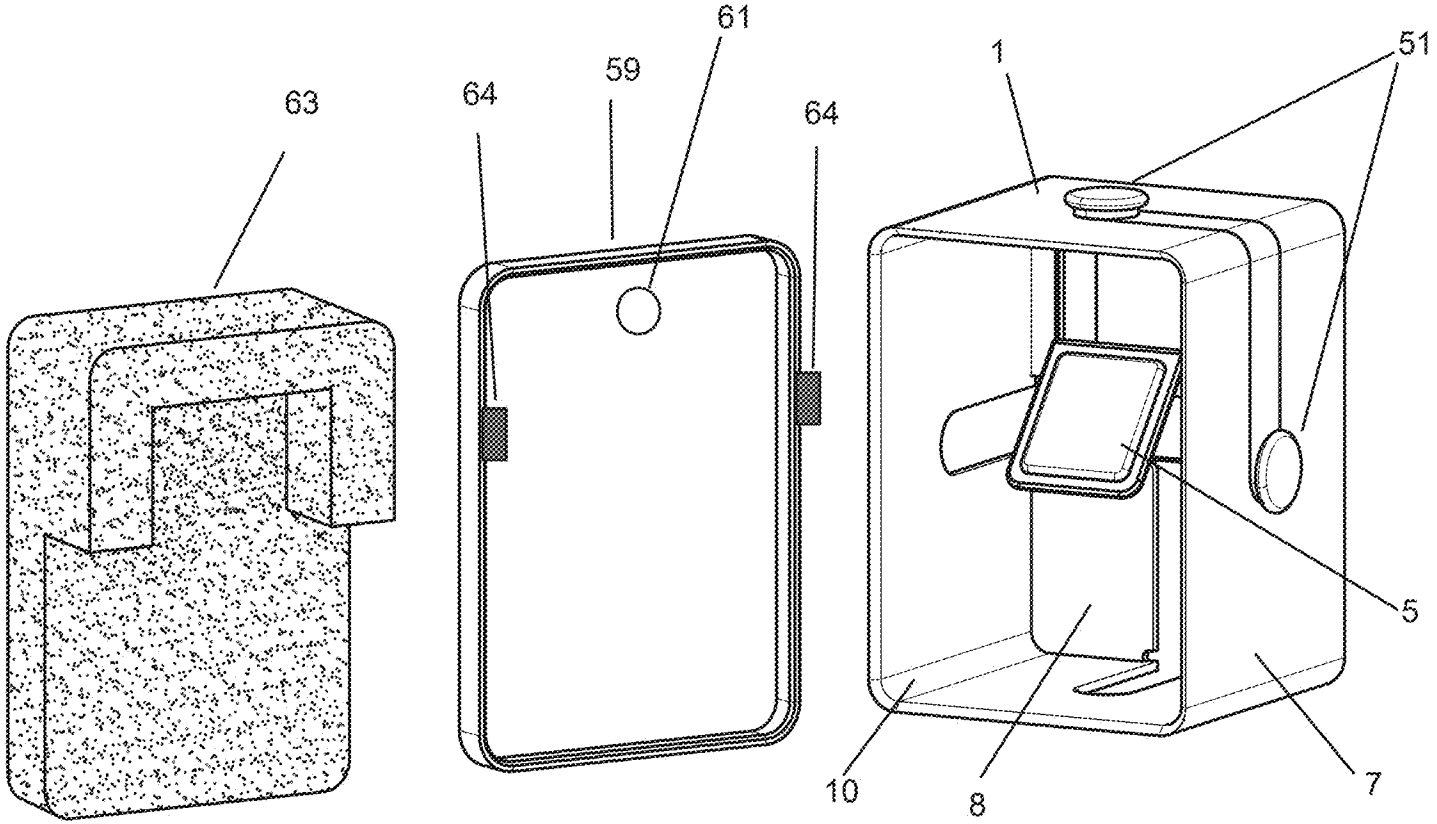
FIG. 20 is an exploded view of one embodiment of the disclosed container, a lid, and a separate spacer.

As shown in FIGS. 18-20, a cover 59 sized to cover the opening in the disclosed display container's housing 7 may be used to further the display container's protective capabilities. Any durable material, including metal, wood, glass, crystal, carbon fiber, or polymer, may be used for this cover, and the cover may be opaque or transparent. The top of the cover may include a handle or cutout 61 which serves as a grip for easy removal of the cover 59 from the display container 1. A latch, catch, or lock 64 may be added to the container to hold the display case cover in place on the display container. The latch, catch, or lock 64 may serve to help prevent watch theft of a watch from the display container.

As shown in FIGS. 19 and 20, a spacer 63 may be optionally added to the display case to further protect the watch during transport. The spacer is shaped to conform partially or wholly around the hanger or around the combination of the hanger 5 and a watch 3 on the hanger 5. The spacer's 63 shape should occupy a portion of the interior volume of the container while holding the hanger stationary in place. Any suitable material may be used for the spacer 63, including but not limited to: foam, rubber, polystyrene, plastic, molded fiber, paper, metal, and wood. Several spacers may be used in unison, or a single spacer may be used. The spacer 63 may be affixed to the cover such that installation of the cover places the spacer into the interior volume. Alternatively, as shown in FIG. 20, the spacer 63 may be separate from the cover 59.

Figure 21:
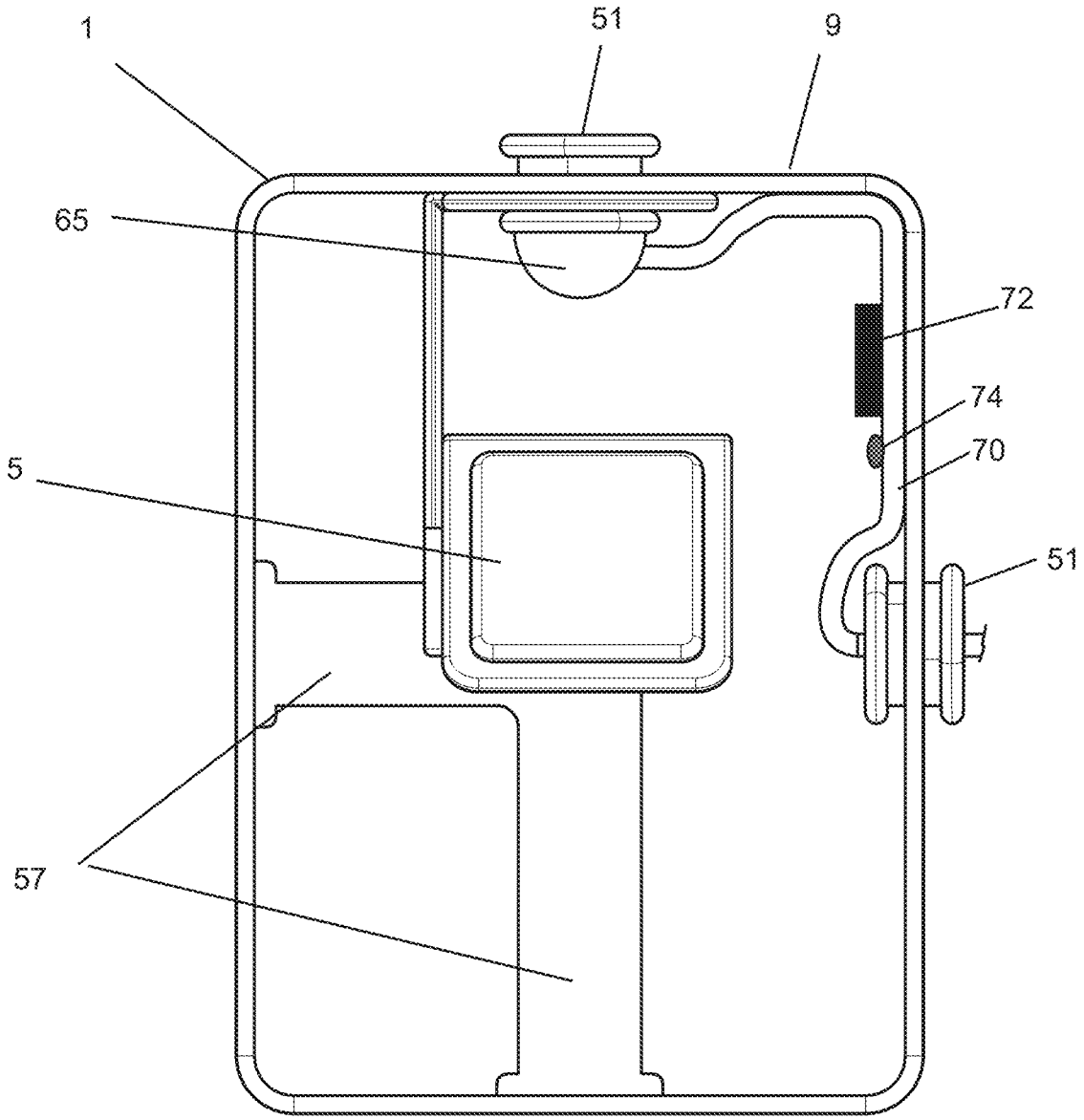
FIG. 21 is a front view of one embodiment of the disclosed container with an interior light source.

As shown in FIG. 21, a light source 65 may be included within the interior volume of the container to increase a watches' visibility during display. This light source 65 may be mounted on a wall 9 of the container 1, built into one of the walls 9 of the container 1, mounted onto the container's hanger 5, or built into the container's hanger 5. The light source 65 may be a powered light source, function via fluorescence, be powered and fluorescent.

If the light source 65 is powered, the power may be supplied via a power supply or power supply circuit 70 which causes the light source to illuminate the interior volume of the container to maximize the watch's visibility within the container 1 during display. The power supply or power supply circuit may be attached to the interior of the housing walls, or may run through the housing walls. A light controller or light processor 72 may be added to adjust the brightness, color, timing, and on/off status of the light source. This light controller or light processor 72 may be set to adjust the light source upon specific time intervals, or adjust the light source at a specific time of day. The light controller or light processor may be connected to communications circuitry 74 which allows the processor to be directly or wirelessly controlled by a controller, remote, or software application.

Figure 22:
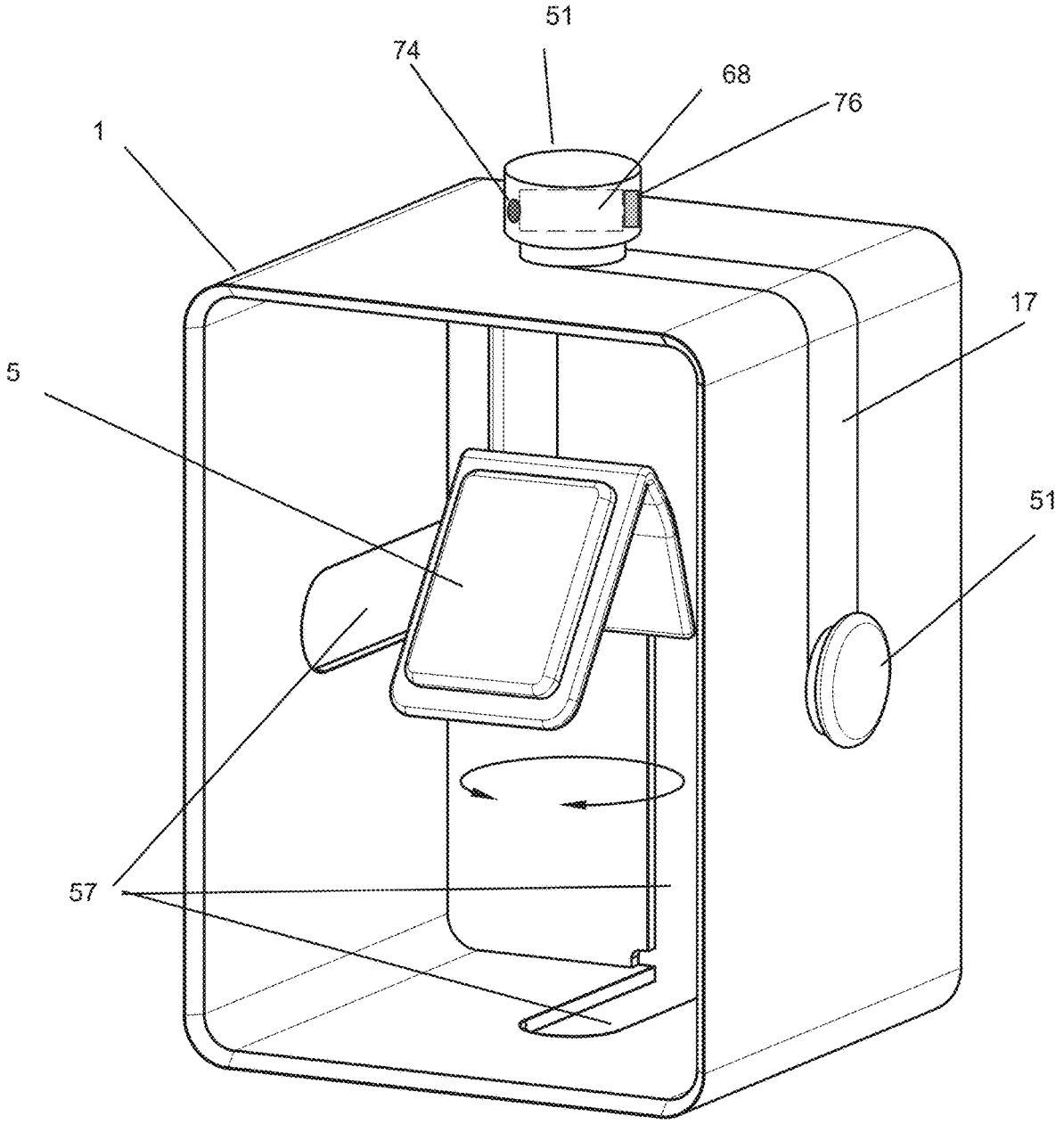
FIG. 22 a front right side elevational view of one embodiment of the disclosed container with rotor motor that spins the interior hanger.

As shown in FIG. 22, the hanger mount 11, hanger connector 23, or external housing connector may include a rotor motor 68 which rotates the hanger mount or hanger connector, thereby rotating any attached hanger within the container housing. A power supply or power supply circuit may power the motor to spin the hanger. A rotation controller or rotation processor 74 may be used to adjust the speed, timing, and on/off status of the hanger's rotation source. This rotation controller or rotation processor may be set to adjust the rotation upon specific time intervals, or adjust the rotation at a specific time of day. The rotation controller or rotation processor may be connected to communications circuitry 74 which allows the processor to be directly or wirelessly controlled by a controller, remote, or software application.

The light source 65 or rotor motor's power supply or power supply circuit may take the form of any combination of a battery, a power cord, an induction charger, a wireless charger, a wire, or an electrical contact. This power supply circuitry may run though connectors 51 on the exterior of the container, and these connectors 51 may be located on or through an L-shaped portion of the housing. If the connectors 51 have a power supply running through them, then multiple display cases may be stacked together to cause each display case 53 to power light sources in surrounding display containers 1 via the connector power circuits. The group of connected display cases may be powered by a power cord, or by a dock on which the display containers are placed upon or attached too.

Figure 23:
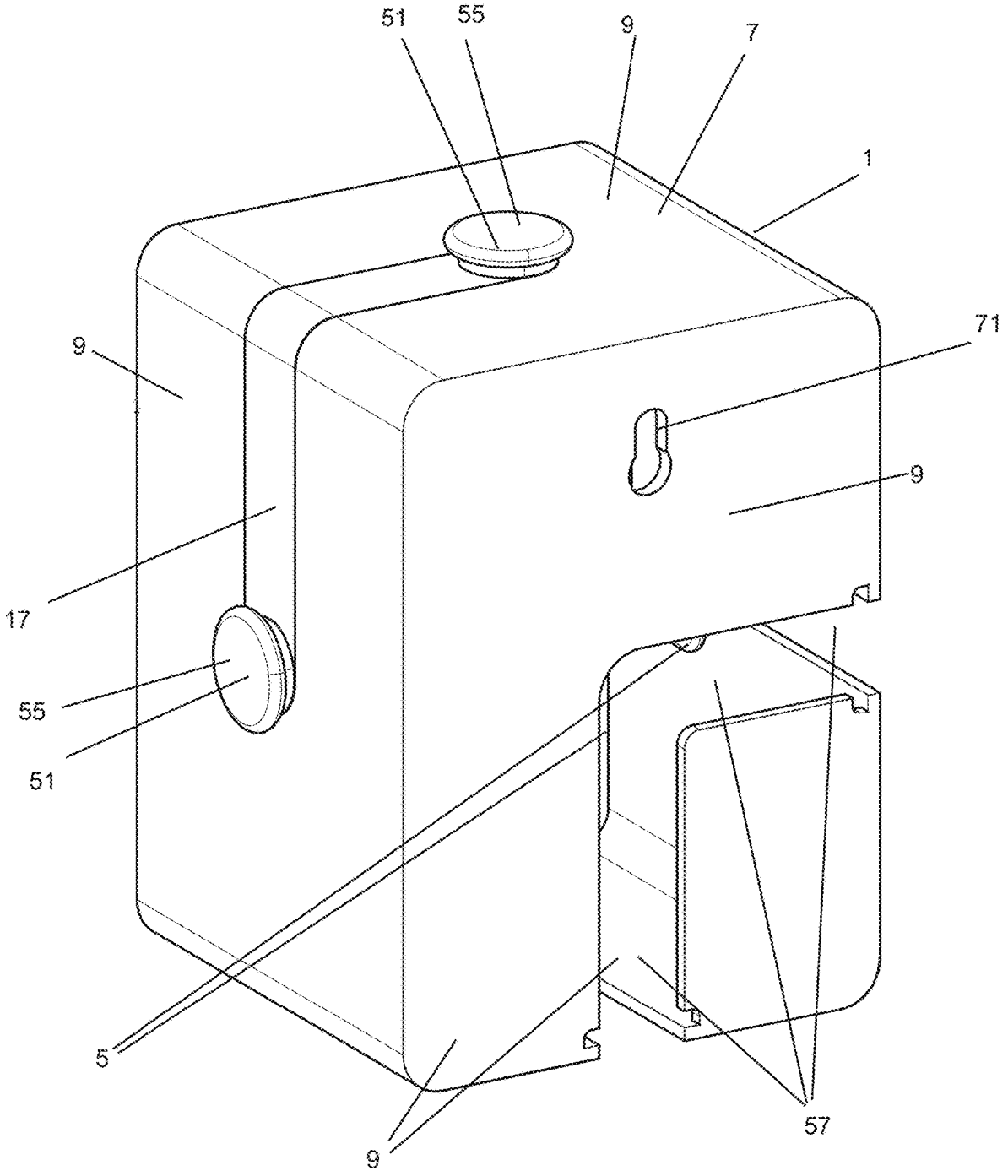
FIG. 23 is a rear right-side elevational view of one embodiment of the disclosed container that includes a mount.

A mount 71 may be attached to an exterior surface of a housing 7 wall 9 to allow a display container 1 or display case 53 to be mounted to a free-standing structure. As shown in FIG. 23, the mount may take the form of a hole made through the container's housing 7. Optionally, a mounting board may be utilized which includes a planar object with a series of mounts attached to it. The mounting board is affixed to a freestanding structure, while display containers are permanently or removably affixed to the mounting board for display. The mounting board may include power sources which power light sources or rotators in the display containers 1.

Figure 24:
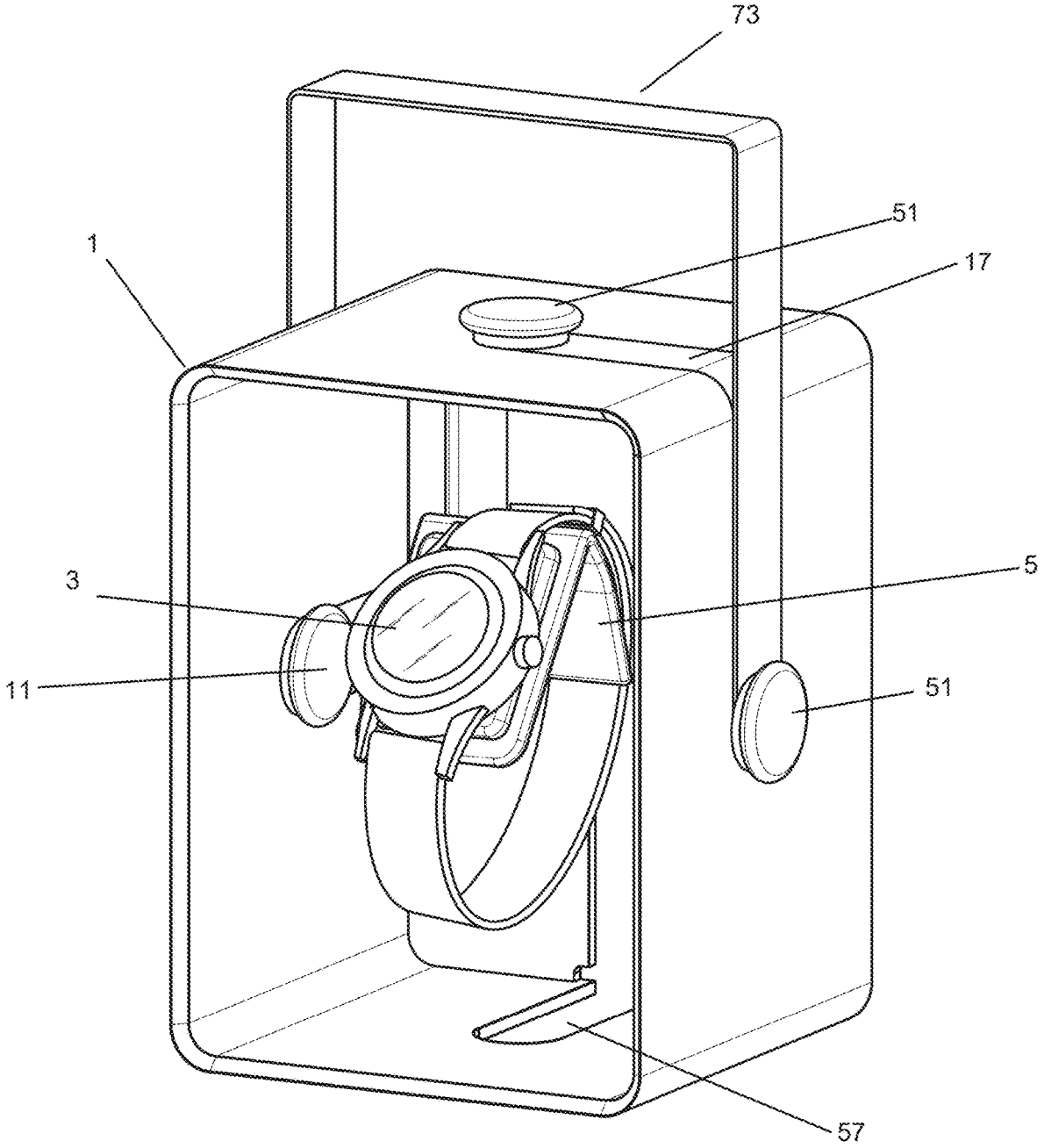
FIG. 24 is a front right side elevational view of one embodiment of the disclosed container that includes a carrying handle.

As shown in FIG. 24, a handle 73 or carrying strap may be attached to the exterior of the container's housing to aid in transportation of the container.

The disclosed display container 1 may be used as a package or kit in combination with the wristwatch 3. Manufacturers may place wrist watches 3 upon the disclosed hanger 5 and then use spacers to hold the hanger 5 in place. The display container may then be used as a shipping container to transport the watch without need for other shipping packages or transportation containers.

The container described above has the advantage of serving as a superior display container for wristwatches. Because the wristwatch is suspended within the container, observers are better able to view bottom angles of the watch that prior art watch holders obscure. Furthermore, the rotational capability of the disclosed hanger means that the watch can be displayed from many different perspectives within the container, thereby enhancing the viewer's viewing experience.

The suspension of the watch by the container protects the watch from scratches. This scratch protection is advantageous because it allows the disclosed display container to be used to transport or ship a watch without ever removing the watch from the container. Because the watch never needs to leave the container, users of the container incur fewer instances where a watch can be dropped and damaged.

Although the disclosure has been shown and described with respect to a certain embodiment or embodiments, equivalent alterations and modifications will occur to others skilled in the art upon reading and understanding of this specification and the annexed drawings. In particular regard to the various functions performed by the above described elements (components, assemblies, devices, compositions, etc.), the terms (including any reference to a "means") used to describe such elements are intended to correspond, unless otherwise indicated, to any element which performs the specified function of the described element (i.e. that is functionally equivalent), even though not structurally equivalent to the disclosed structure which performs the function in the herein illustrated exemplary embodiment or embodiments of the disclosure. In addition, while a particular feature of the disclosure may have been described above with respect to only one or more of several illustrated embodiments, such feature may be combined with one or more other features of the other embodiments, as may be desired and advantageous for any given or particular application.

What is claimed is:

1. A wristwatch-holding container comprising:

a housing having walls, the walls defining an interior volume within the housing, the interior volume being accessible through an opening in the housing:

a hanger mount attached to one of the walls; and an interior hanger suspended within the interior volume and removably connectable to the hanger mount, the interior hanger being configured to suspend a wristwatch within the inner volume without contacting the walls.

2. The container of claim 1, further comprising at least one connector on an exterior surface of the housing.

3. The container of claim 2, wherein the connector is a side-lock mechanism.

4. The container of claim 2, wherein the walls include at least five walls, and wherein a slot extends continuously through the housing across at least three adjacent walls.

5. A display case comprising a plurality of the containers of claim 2, wherein the plurality of containers are attached adjacently to each other via the at least one connector.

6. The container of claim 1, further comprising:

a light source located within the interior volume that illuminates the interior volume; and a power source that powers the light source, wherein the power source runs through the at least one connector.

7. The container of claim 1, further comprising a lid which is shaped to cover the opening in the housing.

8. The container of claim 7, further comprising a removeable spacer which is shaped to conform around the interior hanger, wherein the removeable spacer occupies at least a quarter of the interior volume when the lid covers the opening.

9. The container of claim 8, wherein the at least one removeable spacer is attached to the lid.

10. The container of claim 1, wherein an L-shaped portion of the housing removably connectable to another portion of the housing, wherein the hanger mount is attached to the L-shaped portion of the housing.

11. The container of claim 1, further comprising a mount on an exterior surface of the housing for mounting the container to a free-standing structure.

12. The container of claim 1, in combination with a wristwatch mounted on the interior hanger, wherein the wristwatch is suspended and does not contact any portion of the housing.

13. The container of claim 1, wherein the interior hanger comprises:

a hanger connector configured to removably attach the interior hanger to the hanger mount; and a continuous monolithic single piece body comprising:

a support with a proximal end attached to the hanger connector, and a distal end extending away from the hanger connector, and an inverted V-shaped watch holder connected to the distal end of the support, wherein the inverted V-shaped hanger has a first leg and a second leg.

14. The container of claim 13:

wherein the first leg and second leg of the V-shaped hanger are connected to each other at an internal angle between 40° and 0°;

wherein the first leg has a length greater than a length of the second leg; and wherein the second leg consists of two planar portions that are connected to each other at an internal angle between 150° and 175°.

15. The container of claim 13, wherein the connector is a U-shape connector.

16. The container of claim 13, wherein the hanger mount includes a rotor motor which rotates the hanger.

17. An interior hanger for suspending a watch in a container, comprising:

a hanger connector; and a continuous monolithic single piece body comprising:

a support with a proximal end attached to the hanger connector, and a distal end extending away from the hanger connector, and an inverted V-shaped watch holder connected to the distal end of the support, wherein the inverted V-shaped hanger has a first leg and a second leg.

18. The interior hanger of claim 17:

wherein the first leg and second leg of the V-shaped hanger are connected to each other at an internal angle between 40° and 70°;

wherein the first leg has a length greater than a length of the second leg; and wherein the second leg consists of two planar portions that are connected to each other at an internal angle between 150° and 175°.

19. The interior hanger of claim 16, wherein the hanger connector is formed from a portion of the monolithic body.

* * * * *